US008933377B2

(12) United States Patent
Wilde

(10) Patent No.: US 8,933,377 B2
(45) Date of Patent: Jan. 13, 2015

(54) CONTROL DEVICE FOR AN ELECTRICAL HEATING DEVICE FOR A COOKING FIELD, COOKING FIELD AND METHOD FOR OPERATING SUCH AN ELECTRICAL HEATING DEVICE

(75) Inventor: Eugen Wilde, Knittlingen (DE)

(73) Assignee: E.G.O. Elektro-Gerätebau GmbH, Oberderdingen (DE)

( * ) Notice: Subject to any disclaimer, the term of this patent is extended or adjusted under 35 U.S.C. 154(b) by 593 days.

(21) Appl. No.: 13/315,984

(22) Filed: Dec. 9, 2011

(65) Prior Publication Data

US 2013/0146585 A1 Jun. 13, 2013

(51) Int. Cl.
*H05B 1/02* (2006.01)

(52) U.S. Cl.
USPC ..... 219/491; 219/485; 219/486; 219/446.1; 219/448.11; 219/448.17; 219/510

(58) Field of Classification Search
CPC ..... H05B 3/68; H05B 3/746; H05B 2213/04; H05B 1/0202; H05B 1/0266
USPC ..... 219/491, 486, 485, 494, 446.1, 448.11, 219/448.17, 509, 510
See application file for complete search history.

(56) References Cited

U.S. PATENT DOCUMENTS 1,998,330 A 4/1935 Nicholson et al.
3,819,903 A 6/1974 Frick
4,371,780 A 2/1983 Gössler et al.
4,388,520 A 6/1983 McWilliams
4,393,299 A 7/1983 McWilliams
4,633,238 A * 12/1986 Goessler et al. ..... 340/593
4,645,911 A 2/1987 Husslein
4,700,051 A 10/1987 Goessler et al.
5,051,561 A 9/1991 McWilliams et al.
5,138,135 A 8/1992 Husslein
5,235,159 A * 8/1993 Kornrumpf et al. ..... 219/486
5,270,519 A 12/1993 Higgins
5,498,853 A 3/1996 Gross et al.
5,517,002 A 5/1996 Higgins
5,977,523 A 11/1999 Scott
6,064,045 A 5/2000 Reichert et al.

(Continued)

OTHER PUBLICATIONS

U.S. Official Action dated Feb. 12, 2014 in U.S. Appl. No. 13/315,829.

(Continued)

*Primary Examiner* — Mark Paschall
(74) *Attorney, Agent, or Firm* — Lee & Hayes, PLLC

(57) ABSTRACT

A control device for an electrical heating device for a cooking field with a cooking field plate comprises an electro-mechanical switching device for adjusting a power of said heating device with different power levels and comprises two different heating element. The switching device is configured so that starting from a zero-position and rotating in a first rotation direction, a power level for a first heating element is adjusted in a cooking-mode. Rotation in the other direction activates a second heating element in a warm-keeping mode with significantly lower power. A relay is closed by a thermo-mechanical temperature sensing device below a defined switching temperature of 60° C. to 100° C. and opened above the switching temperature. When closed, the relay connects the two heating elements to an operating voltage for common operation. When opened, the first heating element is switched off for exclusive operation of the second heating element.

13 Claims, 3 Drawing Sheets

(56) References Cited

U.S. PATENT DOCUMENTS

| | | | | |
|---|---|---|---|---|
| 6,211,582 | B1 | 4/2001 | Reimold et al. | |
| 6,765,179 | B2 | 7/2004 | Wilde et al. | |
| 7,119,654 | B2 | 10/2006 | Losbichler | |
| 8,344,292 | B2 * | 1/2013 | Franca et al. | 219/480 |
| 2002/0000434 | A1 | 1/2002 | Morsch et al. | |
| 2002/0011480 | A1 | 1/2002 | Schilling et al. | |
| 2006/0027562 | A1 | 2/2006 | Toyos et al. | |
| 2006/0027564 | A1 | 2/2006 | Wilde et al. | |
| 2013/0146582 | A1 | 6/2013 | Wilde | |
| 2013/0146583 | A1 | 6/2013 | Wilde | |

OTHER PUBLICATIONS

U.S. Official Action dated Feb. 28, 2014 in U.S. Appl. No. 13/315,677.

U.S. Official Action dated Jun. 24, 2014 in U.S. Appl. No. 13/315,677.

U.S. Official Action dated Sep. 19, 2014 in U.S. Appl. No. 13/315,677.

U.S. Notice of Allowance dated Jul. 8, 2014 in U.S. Appl. No. 13/315,829.

* cited by examiner

CONTROL DEVICE FOR AN ELECTRICAL HEATING DEVICE FOR A COOKING FIELD, COOKING FIELD AND METHOD FOR OPERATING SUCH AN ELECTRICAL HEATING DEVICE

CROSS REFERENCE TO RELATED APPLICATIONS

This application is related to:

U.S. patent application Ser. No. 13/315,677, filed on Dec. 9, 2011, entitled "Heating Device, Cooking Field And Method For Operating A Heating Device," which is also identified by; and U.S. patent application Ser. No. 13/315,829, filed on Dec. 9, 2011, entitled "Heating Device, Method of Producing a Heating Device And Method For Operating A Heating Device," which is also identified by, the contents of both of which are incorporated by reference for all that they teach.

BACKGROUND

The disclosure generally relates to a control device for an electrical heating device for use in a cooking field with a cooking field plate. The disclosure also relates to such a cooking field with an electrical heating device and such a control device as well as a method for operating and electrical heating device of such a cooking field.

Heating devices for a cooking field are known, for example, from U.S. Pat. No. 4,371,780 that can provide a rather small output of heating power. They comprise a heating element that can be operated continuously to keep food in a saucepan or the like placed above the heating device onto a cooking field plate at a convenient temperature for being directly served. A low power output of such a heating element enables it to be operated without the need of a temperature sensor to avoid damage to the cooking field plate by overheating it. Furthermore, this heating device also comprises a radiant heater with a high heating power output to cook the food in the saucepan. Such a heating device is operated with two control devices for both operating modes.

SUMMARY

A control device is provided for an electrical heating device for a cooking field with a cooking field plate, wherein the electrical heating device can be operated in a warm-keeping mode by the control device with a fast heating of a saucepan containing food to be kept warm and with a fast activation of residual heat signaling indicator to warn a user from a hot cooking field plate where the saucepan is placed.

It is a further object to provide a method for operating an electrical heating device of a cooking field in such a warm keeping mode with low additional effort and mechanical parts.

In one embodiment disclosed herein, a control device is provided for an electrical heating device for a cooking field with a cooking field plate, wherein the heating device is arranged beneath the cooking field plate, the control device including an electro-mechanical switching device for adjusting a power of the heating device with different power levels, wherein the heating device comprises two different heating elements, wherein the electro-mechanical switching device is configured such that starting from a zero-position and rotating in a first rotation direction a power level for a first heating element as a cooking-mode can be adjusted at a defined rotation angle, and wherein by rotating in the other second rotation direction the second heating element is activated as a warm-keeping mode with significantly lower power than operation of the first heating element. The control device also includes a controllable switching device, the controllable switching device configured to be activated via a thermo-mechanical temperature sensing device with an expansion switch such that below a defined switching temperature of 60° C. to 100° C., the controllable switching device is closed, wherein above the switching temperature the controllable switching device is configured to be opened, wherein in the closed state of the controllable switching device the first heating element together with the second heating element is connected to an operating voltage via the controllable switching device for common operation together, and wherein above the switching temperature the controllable switching device is opened via activation by the expansion switch for switching off the first heating element for exclusive operation of the second heating element alone.

In another embodiment disclosed herein, a cooking field includes a cooking field plate, an electrical heating device comprising a radiant heater arranged beneath the cooking field plate, the radiant heater comprising a first and second heating element arranged on a common support, and wherein the second heating element has a significantly lower power density relative to the first heating element, the lower power density being up to 3 W/cm$^2$ with regard to a surface area of the common support, and a control device as described above.

In another embodiment disclosed herein, a method is provided for the cooking field described above, the method comprising operating in a first operating mode wherein only the first heating element is operated with power high output, and operating in a second operating mode comprising a warm-keeping mode wherein the second heating element is operated continuously with a lower power density, wherein a thermo-mechanical expansion switch provides a temperature limiting function at the underside of the cooking field plate with a triggering temperature between 60° C. and 100° C., wherein the first heating element is connected by the expansion switch to an operating voltage such when a temperature below the triggering temperature is detected, the first heating element is also activated, and wherein in the case of a temperature above the triggering temperature is detected, the first heating element is switched off and the second heating element is activated and operated alone.

These and further features can be gathered from the claims, description and drawings and the individual features, both singly and in the form of sub combinations, can be implemented in an embodiment of the invention and in other fields and can represent advantageous, independently protectable constructions for which protection is claimed here. The subdivision of the application into individual sections and the subheadings in no way restrict the general validity of the statements made thereunder.

BRIEF DESCRIPTION OF THE DRAWINGS

Exemplary embodiments of the invention are described hereinafter relative to the attached diagrammatic drawings, wherein.

DETAILED DESCRIPTION OF THE EMBODIMENTS

Figure 1:
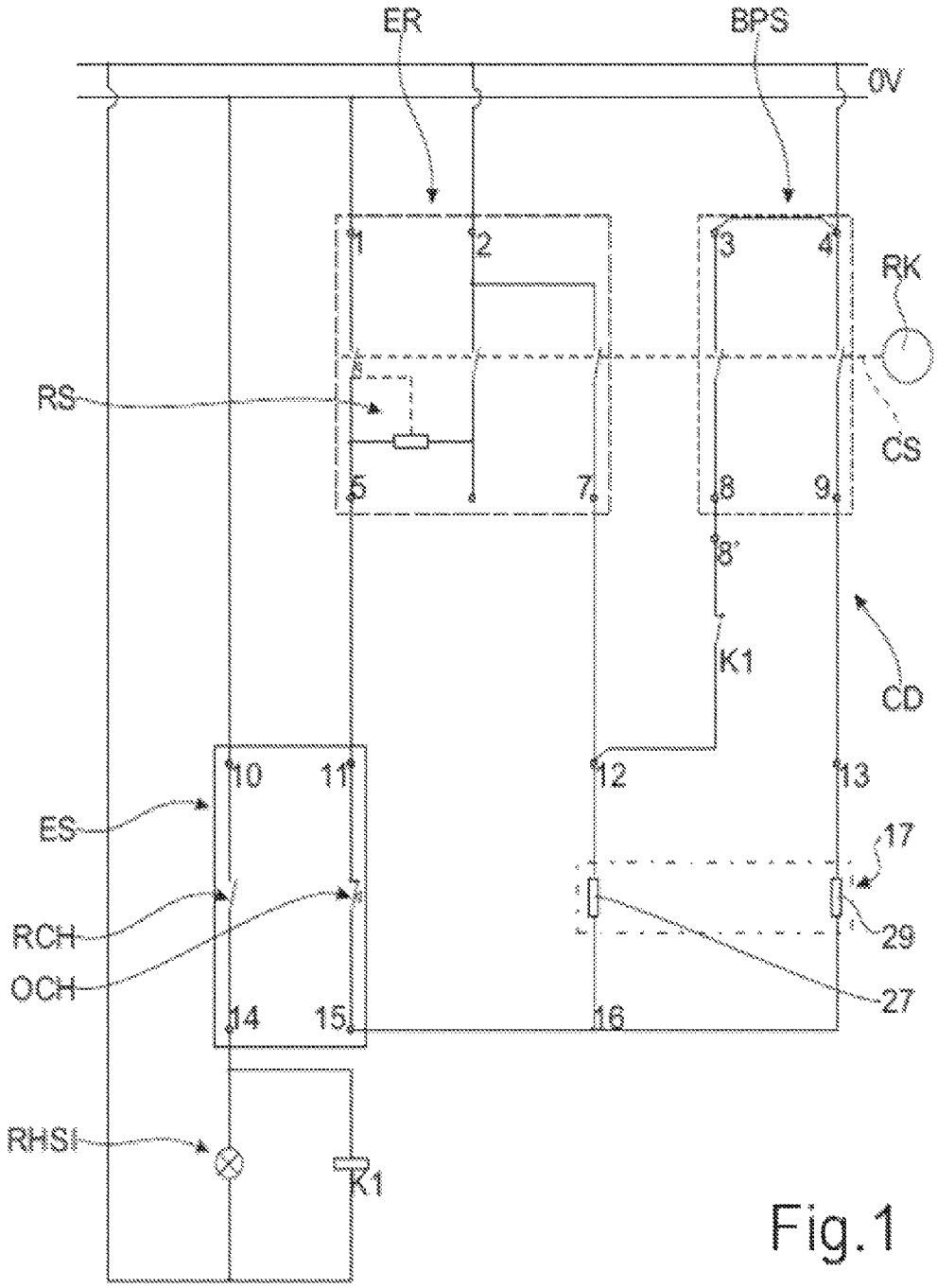
FIG. 1 illustrates a switching concept for a control device according to the invention.

According to one embodiment disclosed herein, a control device is provided for an electrical heating device for a cooking field with a cooking field plate, wherein the heating device is arranged beneath the cooking field plate. The control device comprises an electro-mechanical switching device for adjusting a power of said heating device with different power levels, which is known for example from U.S. Pat. No. 6,211,582 or U.S. Pat. No. 6,064,045. The heating device comprises two different heating elements, which is also known from U.S. Pat. No. 4,371,780. The electro-mechanical switching device is provided with a control shaft in a way that starting from a zero-position, the control shaft can be rotated in a first rotation direction to adjust a power level for a first heating element in a cooking mode, wherein the power level is defined by the angle of rotation. In this cooking mode, food in a saucepan placed above the heating device can be cooked in the usual way. This first heating element can have a power output of, for example, 1400 Watts up to some more than 2000 Watts. The first heating element is operated in the cooking mode in a clocked or pulsed mode with ON-time periods and OFF-time periods. By varying those ON-time periods and OFF-time periods dependent on the angle of rotation, a resulting power level can be obtained. This has been well known in the art for many years.

By rotating the control shaft of the control device in the other second rotation direction, the second heating element is activated as a warm-keeping mode, wherein the second heating element has a significantly lower power output than the first heating element. This lower power output can be for example 50 Watts up to 150 Watts, preferably about 100 Watts. The control device comprises a controllable switching device, which can be a relay in a preferred embodiment. This controllable switching device is activated via a thermo-mechanical temperature sensing device comprising an expansion switch such that beneath a defined switching temperature of, for example, 60° C. to 100° C., the controllable switching device is closed. Such a thermo-mechanical temperature sensing device is known from U.S. Pat. No. 4,633,238 or U.S. Pat. No. 5,498,853, and preferably has a longitudinal sensing part.

In the closed state of the controllable switching device, it connects the first heating element together with the second heating element to an operating voltage for common operation together to generate heat, in particular for fast generation of heating power to reach the temperature for the warm-keeping mode as quick as possible. Above the switching temperature, the switching device is opened via activation by the expansion switch of the temperature sensing device, which again switches off the first heating element. After that, only the second heating element is operated alone to generate heat with its relatively low power level.

The concepts disclosed herein provides for basically the second heating element to operate in the heating device in the warm-keeping mode with a relatively low power output, which can be one-tenth or less of the power output of the cooking heating element. However, such a low power output would mean that a temperature on the top surface of the cooking field for keeping warm a saucepan placed upon it would be reached only after long time spans, such as 10 minutes or even 20 minutes. To obviate this problem, the first heating element, which has a heating power of more than 10 or 20 times of the second heating element, is additionally operated for a short duration, which is most probably less then one minute, to speed up the actual start of the warm-keeping mode. In this sense, the first heating element operates as a kind of short-time booster for the heating device to reach a desired temperature level, and then the second heating element alone takes over, which is sufficient to keep the necessary temperature at the cooking field plate.

Furthermore, the activation of the first heating element serves to activate the thermo-mechanical temperature sensing device, which again activates a residual heat signaling indicator such as a lamp, which is basically known in the art to warn a user from touching the cooking field plate when it has a dangerously high temperature of above 50° C. up to 90° C.

In another embodiment, a connection of said switching device to the operating voltage is provided in a switching device casing. In this switching device casing, a switch for connecting the second heating element to the operating voltage is also provided. This is regarded as advantageous for a simple construction, which does not occupy too much space.

Furthermore, it is possible to provide the control device comprising the switching device in a backpack switch casing. This backpack switch casing can be mounted onto the electro-mechanical switching device. In this case, they can be operated together with a single control shaft to have the same angle of rotation on both of them. However, the switching device, which can preferably be a relay, may be provided in a different casing than other components of the control device.

Preferably, the expansion switch is a thermo-mechanical switch with a longitudinal rod-like sensing part comprising at least one thermo-mechanically activated switching contact, for example as is known from U.S. Pat. No. 4,633,238. Preferably, a triggering point or triggering temperature of this switching contact and of the thermomechanical switch is between 60° C. and 100° C. This triggering point or triggering temperature may be used to activate an optical residual heat signaling indicator to warn a user from a hot cooking field plate, as has been described before. The optical residual heat signaling indicator can be in a simple form of a lamp, an LED, or any other form of audio and/or visual indication and can be activated or switched on by closing a switching contact of the expansion switch. Furthermore, the thermo-mechanical temperature sensing device can have a second expansion switch or switching contact with a triggering point or a triggering temperature of about 500° C. to 600° C. This serves as an overheat protection for the cooking field plate in the cooking-mode, which again does note play any role for this invention.

When the switching device is closed, the first heating element can be operated in a continuous mode or a in a pulsed mode, if the rotation angle of the electromechanical switching device or its control shaft is in the second rotation direction for a warm-keeping mode. However, it is regarded as advantageous to operate the first heating element in a continuous mode to reach as fast as possible a desired temperature on the top surface of the cooking field plate for the warm-keeping mode. This is also regarded as being advantageous for an activation of the residual heat signaling indicator.

In the case of the rotation position of the switching device or its control shaft close to a zero-position, a pulsed operation mode of the first heating element may be provided with low power output, wherein the ON-time periods are significantly shorter than the OFF-time periods. After rotating the switching device or its control shaft significantly further into this second rotation direction, the ON-time periods are becoming longer than the OFF-time periods. This serves for effecting a higher power output of the first heating element. Contrary to an operation of the first heating element in a continuous mode for faster reaching the operating temperature for the warm-keeping mode, such a variation of the heating mode of the first heating element with ON-time periods and OFF-time periods being variable enables a user to define whether this warm-keeping mode shall be reached slow or fast.

In an embodiment involving a cooking field, an electrical heating device and a control device for it as described before are provided, wherein the control device serves for operating the electrical heating device. The electrical heating device preferably is a radiant heater arranged beneath the cooking field plate. The heating device comprises a first and a second heating element arranged on a common support. The second heating element has a significantly lower power density than the first heating element, wherein this power density can be up 3W/cm$^2$ with regard to a surface area of the support. Preferably, the power density is somewhat lower, for example less than 0.8W/cm$^2$, which means, in practice, that the second heating element can have a power output of about 100 Watts. In contrast, the first heating element can have a power output of more than 1000 Watts up to more than 2000 Watts.

Embodiments disclosed herein also provide for the use of a single control shaft for rotating the electro-mechanical switching device for adjusting a power of the heating device with operation of the first heating element alone in a first rotation direction. When rotating the control shaft into the other second rotation direction, the warm-keeping mode can be activated and controlled or adjusted, respectively. This enables a user to completely control a heating device in the cooking-mode as well as in the warm-keeping mode with only one control shaft.

Figure 3:
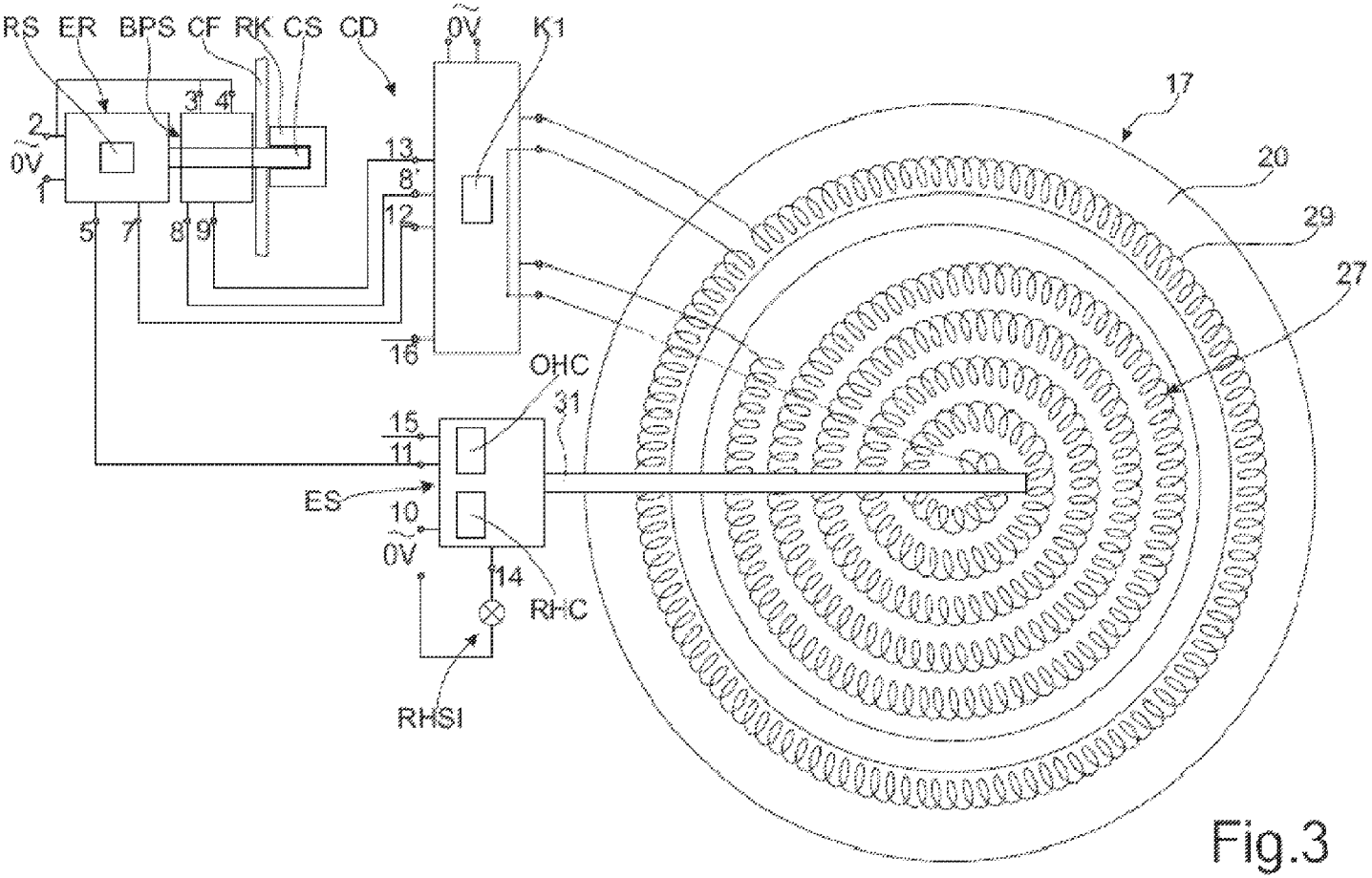
FIG. 3 illustrates a top view onto a heating device with two heating elements being connected to the control device of FIG. 1.

Turning now to the figures, and specifically turning first to FIG. 3, a top view of a heating device 17 is shown. The heating device 17 comprises a central main radiant heater 27 as a first heating element with two electrical connections to a control device ("CD"). This main radiant heater 27 serves for the cooking-mode operation and has a power output of significantly above 1000 Watts.

Under a rim part 20 of the heating device 17, a second heating element 29 is provided with a much lower our output, for example only 100 Watts. This second heating element 29 is used for the warm-keeping mode. Details of such a warm-keeping mode as well as of a construction of such a heating device can be taken from the patent application from co-pending application no. "13/315,829" filed on Dec. 9, 2011 by the same applicant.

Figure 2:
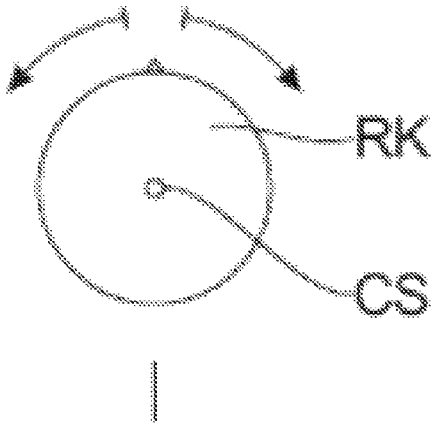
FIG. 2 illustrates a front view on a rotation knob of an energy regulator.

In FIG. 1, a control device CD is shown which comprises an energy regulator ER as an electro-mechanical switching device, which is basically known in the prior art, see above. A regulator switch RS is provided therein which serves for a pulsed operation mode of the energy regulator controlling ON-times and OFF-times of the radiant heater 27 in the cooking mode. Furthermore, there is provided on a control shaft CS of the energy regulator ER a rotation knob RK, which can be rotated in two rotation directions. This is shown in FIG. 2. The rotation knob RK on control shaft CS can be turned clock-wise or anti-clock-wise for a rotation angle of in each case approximately 180°. This, again, rotates switching devices in the energy regulator ER. When turned clock-wise, the energy regulator ER can set in usual manner the power level for the heating device 17 with the main radiant heater 27, wherein the power level corresponds to the rotation angle. This effects the large heating power to be provided in the heating device.

When turned anti-clock-wise, the energy regulator ER can start the warm-keeping mode with either a fixed power level or an adjustable power level, which again would preferably depend on the rotation angle. The energy regulator ER is connected to operating voltage OV via contacts 1 and 2.

The controllable switching device may be a backpack switch BPS which can be mounted to the energy regulator ER. The backpack switch BPS can be used to activate the heating element 29 for a warm-keeping mode. The backpack switch BPS is also controlled by the rotation knob RK on control shaft CS. This is shown in FIGS. 1 and 3. Turning of the rotation knob RK clock-wise will only take effect on the energy regulator ER and not on the backpack switch BPS. However, turning the rotation knob RK anti-clock-wise will only take effect on the backpack switch BPS to close the switches on contact pairs 3/8 and 4/9 and not take effect on the energy regulator ER. Backpack switch BPS is also connected to the heating device 29 via the contact 13 of the control device CD.

A thermo-mechanical expansion switch ES with a longitudinal sensing part 31 of FIG. 3, which is known from the prior art of U.S. Pat. No. 4,633,238, to which an explicit incorporation by reference is made herewith, can activate relay contact K1 via the first switch contact RHC, which can happen at a temperature of about 60° C. to 100° C. This switch contact RHC in turn activates on the one hand the residual heat signaling indicator RHSI. A relay K1 is provided as part of the separately controllable switching device. It is connected with its relay switch to contact 8' of the backpack switch BPS and contact 12 of the control device CD. Relay K1 is switched on the other hand when the switch contact RHC switches and will then disconnect or switch off the main radiant heater 27 in the warm-keeping mode after the expansion switch ES with its longitudinal sensing part 31 has sensed the temperature of more than 60° C. to 100° C. This means that the warm-keeping mode can now be run alone by the heating element 29 and the main radiant heater 27 is no more needed. The residual heat signaling indicator RHSI are connected to the expansion switch via contact 14 and are also connected to the operating voltage OV. The relay K1 in the control device CD is connected to contact 14 and to the operating voltage OV for its own power consumption.

The expansion switch ES has a second switch contact OHC, which switches at much higher temperatures, for example above 500° C. or 600° C. This is being done to protect a cooking field plate CF made of glass ceramic above the heating device 17 from dangerously high temperatures. Above such high temperatures, the switch contact OHC will switch off the main radiant heater 27 and the heating element 29.

The expansion switch ES is connected to operating voltage OV via contact 10 and to contact 5 of the energy regulator ER via contact 11. Contact 15 is connected to contact 16 of the control device CD, which again is connected to the main radiant heater 27 and heating element 29.

When the rotating knob RK is rotated in a first clock-wise rotation direction, it changes the position of the regulator switch RS for different power levels of the main radiant heater 27 in the cooking mode, as is known in the art. When rotating the rotating knob RK in the other second or anti-clock-wise rotation direction, the switch between the points 4 and 9 is closed and the heating element 29 is connected to the operating voltage OV via points 4 and 15. Furthermore, the main radiant heater 27 is connected to operating voltage OV via the contacts 4, 3 and 8 via the relay contact K1 and contact 15.

If the thermo-mechanical expansion switch is heated above a temperature of 60° C. to 100° C. by the main radiant heater 27 and, additionally, the heating element 29, the residual heat switch RHC is closed and the residual heat signaling indicator RHSI is activated such that a lamp, light, audible sound, or any other form of indication is provided to a user indicating to the user that a cooking field plate is dangerously hot or too hot to touch. At the same time the relay K1 is activated to cut off the operating voltage from the main radiant heater 27 beneath contact 8 at the backpack switch. After that, only the heating element 29 is operated, which is sufficient to keep the top surface of the cooking field plate warm enough for the warm-keeping mode. However, as the main radiant heater 27 has helped to reach this warm-keeping temperature in very short time due to its much higher power level, the heating element 29 needs only to maintain the temperature of the cooking field.

One of the advantages of this embodiment is that the main radiant heater is used to reach the temperature of the cooking field much faster than is necessary for the warm-keeping mode. After reaching this temperature, the main radiant heater is switched off automatically. Furthermore, the expansion switch ES is used, which is provided anyway, for automatically switching off the main radiant heater. No additional devices are necessary. Furthermore, as the temperature of the cooking field for the warm-keeping mode is about the same as for the residual heat signaling indicator to be activated, the same switch or the same signal can be used to switch off the main radiant heater automatically. This is done via the relay K1.

With the embodiment disclosed, the normal heating mode is as is known in the art, effected by rotation of the rotation knob clock-wise with different power levels. Heating is effected via the main radiant heater 27 alone. Also the control function of the expansion switch with signaling a residual heat of the cooking field plate CF is possible.

The invention claimed is:

1. A control device for an electrical heating device for a cooking field with a cooking field plate, wherein said heating device is arranged beneath said cooking field plate, said control device comprising:

an electro-mechanical switching device for adjusting a power of said heating device with different power levels, wherein said heating device comprises two different heating elements, wherein said electro-mechanical switching device is configured such that starting from a zero-position and rotating in a first rotation direction a power level for a first heating element as a cooking-mode can be adjusted at a defined rotation angle, wherein by rotating in the other second rotation direction said second heating element is activated as a warm-keeping mode with significantly lower power than operation of said first heating element; and a controllable switching device, said controllable switching device configured to be activated via a thermo-mechanical temperature sensing device with an expansion switch such that below a defined switching temperature of 60° C. to 100° C., said controllable switching device is closed, wherein above said switching temperature said controllable switching device is configured to be opened, wherein in said closed state of said controllable switching device said first heating element together with said second heating element is connected to an operating voltage via said controllable switching device for common operation together, and wherein above said switching temperature said controllable switching device is opened via activation by said expansion switch for switching off said first heating element for exclusive operation of said second heating element alone.

2. The control device according to claim 1, wherein a connection of said controllable switching device to said operating voltage is provided in a switching device casing, and wherein in said switching device casing is also provided a switch for connecting said second heating element to said operating voltage.

3. The control device according to claim 2, wherein said switching device is provided in a backpack switch casing, which is mounted onto said switching device.

4. The control device according to claim 3, wherein said backpack switch casing is operated together with said switching device via a single rotation shaft.

5. The control device according to claim 1, wherein said controllable switching device is provided in a different casing than the electro-mechanical switching device.

6. The control device according to claim 1, wherein said expansion switch is a thermo-mechanical switch with a rod-like sensing part with at least one thermomechanically activated switching contact.

7. The control device according to claim 6, wherein a triggering point of said switching contact is between 60° C. and 100° C.

8. The control device according to claim 6, wherein an optical residual heat signaling indicator is provided, which is switched on by closing said switching contact of said expansion switch.

9. The control device according to claim 1, wherein said first heating element is configured to be operation in a continuous or a pulsed mode when said controllable switching device is closed, depending on a rotation angle of said electro-mechanical switching device in said second rotation direction for said warm-keeping mode.

10. The control device according to claim 9, wherein said first heating element is configured to be operated in a pulsed operation mode providing a low power output comprising ON-time periods being shorter than OFF-time periods when said rotation position of said controllable switching device is close to a zero position, and wherein said first heating is configured to provide a higher power output mode in said pulsed operation mode comprising said ON-time periods being longer than said OFF-time periods when said rotation position further into said rotation direction.

11. A cooking field comprising:

a cooking field plate;

an electrical heating device comprising a radiant heater arranged beneath the cooking field plate, said radiant heater comprising a first and second heating element arranged on a common support, and wherein said second heating element has a significantly lower power density relative to the first heating element, said lower power density being up to 3 W/cm$^2$ with regard to a surface area of said common support;

and a control device for operating said electrical heating device, wherein said control device comprises an electro-mechanical switching device for adjusting a power of said heating device with different power levels, wherein said heating device comprises two different heating elements, wherein said electro-mechanical switching device is configured such that starting from a zero-position and rotating in a first rotation direction a power level for a first heating element as a cooking-mode can be adjusted at a defined rotation angle, wherein by rotating in the other second rotation direction said second heating element is activated as a warm-keeping mode with significantly lower power than operation of said first heating element, and a controllable switching device, said controllable switching device configured to be activated via a thermo-mechanical temperature sensing device with an expansion switch such that below a defined switching temperature of 60° C. to 100° C., said controllable switching device is closed, wherein above said switching temperature said controllable switching device is configured to be opened, wherein in said closed state of said controllable switching device said first heating element together with said second heating element is connected to an operating voltage via said controllable switching device for common operation together, and wherein above said switching temperature said controllable switching device is opened via activation by said expansion switch for switching off said first heating element for exclusive operation of said second heating element alone.

12. The cooking field according to claim 11, wherein said power density is less than 0.8 W/cm$^2$.

13. A method for operating an electrical heating device of a cooking field comprising a cooking field plate, an electrical heating device comprising a radiant heater arranged beneath the cooking field plate, said radiant heater comprising a first and second heating element arranged on a common support, and wherein said second heating element has a significantly lower power density relative to the first heating element, said lower power density being up to 3 W/cm$^2$ with regard to a surface area of said common support, said cooking field further comprising a control device for operating said electrical heating device, wherein said control device comprises an electro-mechanical switching device for adjusting a power of said heating device with different power levels, wherein said heating device comprises two different heating elements, wherein said electro-mechanical switching device is configured such that starting from a zero-position and rotating in a first rotation direction a power level for a first heating element as a cooking-mode can be adjusted at a defined rotation angle, wherein by rotating in the other second rotation direction said second heating element is activated as a warm-keeping mode with significantly lower power than operation of said first heating element, and a controllable switching device, said controllable switching device configured to be activated via a thermo-mechanical temperature sensing device with an expansion switch such that below a defined switching temperature of 60° C. to 100° C., said controllable switching device is closed, wherein above said switching temperature said controllable switching device is configured to be opened, wherein in said closed state of said controllable switching device said first heating element together with said second heating element is connected to an operating voltage via said controllable switching device for common operation together, and wherein above said switching temperature said controllable switching device is opened via activation by said expansion switch for switching off said first heating element for exclusive operation of said second heating element alone, said method comprising:

operating in a first operating mode wherein only said first heating element is operated with power high output; and operating in a second operating mode comprising a warm-keeping mode wherein said second heating element is operated continuously with a lower power density, wherein a thermo-mechanical expansion switch provides a temperature limiting function at the underside of said cooking field plate with a triggering temperature between 60° C. and 100° C., wherein said first heating element is connected by said expansion switch to an operating voltage such when a temperature below said triggering temperature is detected, said first heating element is also activated, and wherein in the case of a temperature above said triggering temperature is detected, said first heating element is switched off and said second heating element is activated and operated alone.

* * * * *